United States Patent [19]

Nigawara

[11] Patent Number: 4,914,705

[45] Date of Patent: Apr. 3, 1990

[54] VOICE MESSAGE ANNOUNCING METHOD AND SYSTEM FOR PLANT

[75] Inventor: Seiitsu Nigawara, Hitachi, Japan

[73] Assignee: Hitachi, Ltd., Tokyo, Japan

[21] Appl. No.: 92,619

[22] Filed: Sep. 3, 1987

[30] Foreign Application Priority Data

Sep. 3, 1986 [JP] Japan ..... 61-205975

[51] Int. Cl.[4] ..... G10L 5/02

[52] U.S. Cl. ..... 381/51; 340/825.51

[58] Field of Search ..... 379/67, 88, 157, 217, 379/374; 381/51, 82

[56] References Cited

U.S. PATENT DOCUMENTS

| | | | |
|---|---|---|---|
| 4,359,713 | 11/1982 | Tsunoda | 381/51 X |
| 4,383,241 | 5/1983 | Kojima et al. | 381/51 X |
| 4,449,232 | 5/1984 | Hashimoto et al. | 381/51 |
| 4,489,436 | 12/1984 | Yoshimura et al. | 381/51 |
| 4,519,027 | 5/1985 | Vogelsberg | 381/51 X |
| 4,560,978 | 12/1985 | Lemelson | 381/51 X |
| 4,723,291 | 2/1988 | Koike | 381/51 |

FOREIGN PATENT DOCUMENTS

| | | |
|---|---|---|
| 57-199006 | 12/1982 | Japan . |
| 59-62913 | 4/1984 | Japan . |

*Primary Examiner*—William M. Shoop, Jr.
*Assistant Examiner*—Marc S. Hoff
*Attorney, Agent, or Firm*—Antonelli, Terry & Wands

[57] ABSTRACT

A system for announcing operating conditions of a plant includes an identifying unit identifying plant site operating conditions on the basis of information signals indicative of the operating conditions at plate sites at the plant site, a voice message signal generating unit determining plant site operating instruction signals on the basis of the identified plant operating conditions and converting the determined instruction signals into corresponding voice message signals, a voice message signal output unit, and a voice message announcing order selection unit including a memory for temporarily storing the voice message signals, an announcing order determining unit for determining the order of announcement of the stored voice message signals, and an output selecting unit for sequentially applying the stored voice message signals to the message signal output unit in the determined order.

11 Claims, 4 Drawing Sheets

VOICE MESSAGE ANNOUNCING METHOD AND SYSTEM FOR PLANT

BACKGROUND OF THE INVENTION

This invention relates to a method and system for announcing, by voice messages, the operating conditions of a plant such as a thermal power plant, or announcing a change or changes in the operating conditions of such a plant, and more particularly to an announcing method and system suitable for application to a plant where a plurality of voice message announcing devices are provided.

A prior art device for announcing the operating conditions of a plant such as a thermal power plant by voice messages is disclosed in, for example, JP-A-59-62193 or JP-A-57-199006. According to the disclosed device, various process variables indicating the operating conditions of the plant are detected, and, when occurrence of an abnormal operating condition is detected, it is automatically announced by a voice message or when a change in the operating conditions is detected, it is also announced by a voice message, so that operators working in the plant can be immediately informed of the occurrence of the abnormal operating condition or the change in the operating conditions.

Practically, it is required to provide an independent voice message announcing device for each of individual suitably-divided units of the plant. When these voice message announcing devices operate independently of one another, voice messages pertaining to different operating conditions are announced simultaneously due to the absence of operational harmony among these devices. Consequently, a problem has arisen in which the announced voice messages mix with one another to an extent that the individual voice messages cannot be distinguished from one another by the operators.

SUMMARY OF THE INVENTION

With a view to solving the prior art problem described above, it is a primary object of the present invention to provide an automatic voice message announcing method and system for use in a plant such as a thermal power plant for sequentially announcing voice messages pertaining to different operating conditions without the possibility of intermixing messages even when a plurality of voice message announcing devices are provided in the plant.

According to the present invention which attains the above object, the priority order of announcement of voice message signals generated from a plurality of independent voice message announcing devices is determined according to their importance, and the messages are serially announced according to the determined priority order.

The voice message signals generated in parallel from the plural independent voice message announcing devices are passed through a common message announcing order selection unit in which the parallel voice message signals demanding announcement are changed into serial signals according to the priority order determined by their relative importance. Thus, the voice message signals generated from the respectively independent plural voice message announcing devices do not mix together, so that the plural operating condition messages can be easily distinguished from one another by the operators. This is advantageous in that, not only can the operators clearly hear the voice messages without any mistake or misinterpretation, but also the noise due to intermixing of voice messages is prevented, improving the environment in which the operators work.

DESCRIPTION OF THE PREFERRED EMBODIMENT

A preferred embodiment of the present invention, when applied to, for example, a thermal power plant, will now be described in detail with reference to FIGS. 1, 2 and 3.

Figure 1:
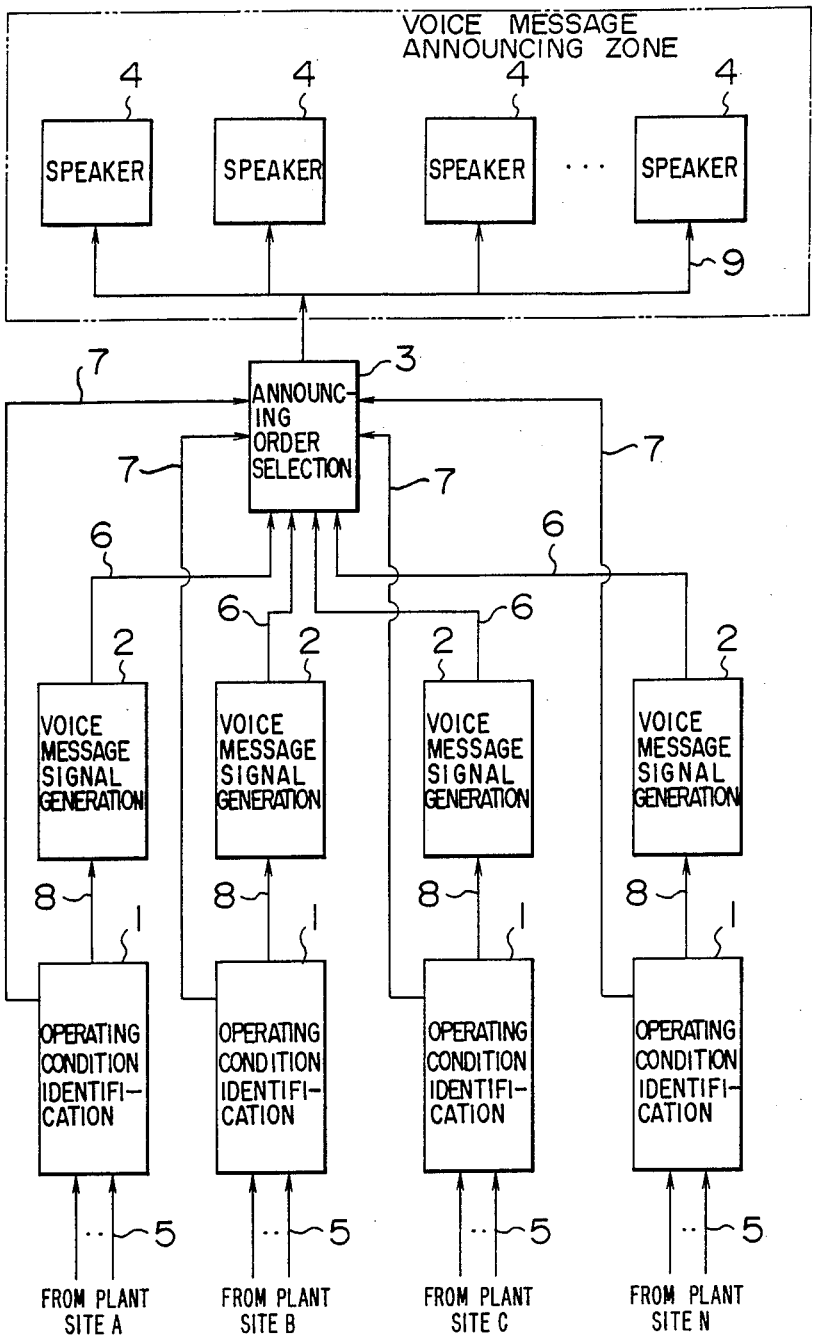
FIG. 1 is a block diagram showing the structure of a preferred embodiment of the automatic voice message announcing system of the present invention.

Referring to FIG. 1, the thermal power plant includes plant sites A, B, C, . . . , N, and the operating conditions of each of these plant sites are announced by voice messages. The objects operated may be machinery or equipments instead of the plants. Information signals 5 indicative of operating conditions of plant site A include process signals representing the pressure, temperature, flow rate, etc. of various fluids (such as water, steam and oil) flowing through plant site A, a voice message signal such as an announcement "water data is normal" announced by the operator who is observing the operating conditions of the plant site A, a machinery rotation noise signal generated from the plant site A, and a video signal representing the state of combustion in the furnace of the boiler of plant site A. Such information signals 5 are applied to a plant operating condition identification unit 1 identifying the operating conditions of the plant site A on the basis of those information input signals. The operating conditions identified by the plant operating condition identification unit 1 are as follows: (1) Whether or not the speed of the plant's steam turbine has increased up to its rated speed; (2) whether or not the pressure of oil lubricating the bearings of the turbine driving the boiler feed water pump has decreased to a dangerously low level; (3) whether or not the quality (iron content, turbidity, pH value, etc.) of boiler feed water has become normal enough to end the water clean-up treatment; (4) whether or not the spare pump for the boiler feed water pump has been started; and (5) whether or not an abnormal operating state occurs in a part of the boiler control system, and the control for that part has been changed over from the automatic mode to the manual mode. When announcement by a voice message of any one operating condition message is required as a result of the identification of the operating conditions of plant site A by the plant operating condition identification unit 1, a voice message announcement instruction signal 8 is applied to a voice message signal generating unit 2 from the plant operating condition identification unit 1. In response to the application of the instruction signal 8, the voice message signal generating unit 2 generates a voice message signal consisting of words which can be understood by a human being. As an example, a voice message signal announcing that "the rotation speed of the steam turbine has attained its rating" is generated as information about the operating condition of the machinery and equipment of the plant site A. As another example, a voice message signal announcing that "the bearings of the turbine driving the boiler feed water pump are abnormal" is generated as information informing of abnormal state of the machinery and equipments of plant site A. As another example, a voice message signal announcing that "the boiler feed water clean-up treatment is to be completed" is generated as an operating instruction. As another example, a voice message signal announcing that "the spare pump for the boiler feed water pump has been automatically started" is generated as information about the operation of the machinery and equipment of plant site A. As another example, a voice message signal announcing that "the boiler control system has been placed in the manual control mode" is generated as information informing of a change in the operation control mode. Such a voice message output signal 6 is applied from the voice message signal generating unit 2 to a message announcing order selection unit 3. The voice message signal is produced by any one of known methods, such as speech synthesis or selective output of speeches previously recorded on a magnetic tape or the like. The units 1 and 2 are also provided for each of the remaining plant sites B, C, . . . , N.

As in the case of plant site A, voice message output signals 6 from the message signal generating units 2 of plant sites B, C, . . . , N are also applied to the message announcing order selection unit 3. When a plurality of demands for announcement of voice messages exist simultaneously, the message announcing order selection unit 3 determines the priority order of announcement of the voice messages according to the contents of the messages and the relative importance of various pieces of information described below, and the voice messages are announced from speakers 4 according to the priority order. Plant operation mode information signals 7 are also applied from the plant operating condition identification units 1 to the message announcing order selection unit 3 to provide information about the various operating conditions on the basis of which the message announcing order selection unit 3 determines the priority order of announcement of the voice message, in addition to the contents of the voice messages. Each of the plant operation mode information signals 7 indicates that the corresponding plant is still in its starting stage and does not still start to transmit electric power, or that the plant is under steady operation with a fixed load, or that the plant is not in operation. The expression "a plurality of demands for announcement of voice messages occur simultaneously" has two meanings. One of the two meanings is that a plurality of demands literally occur at the same time. The other meaning is that two or more demands for announcement of voice messages occur while another voice message is being announced from one of the speakers 4. Actually, the possibility of occurrence of the latter case requiring the control of the priority order of voice message announcement is higher than the former case. The message announcing order selection unit 3 is novel and has not been proposed hitherto in the art.

Figure 2:
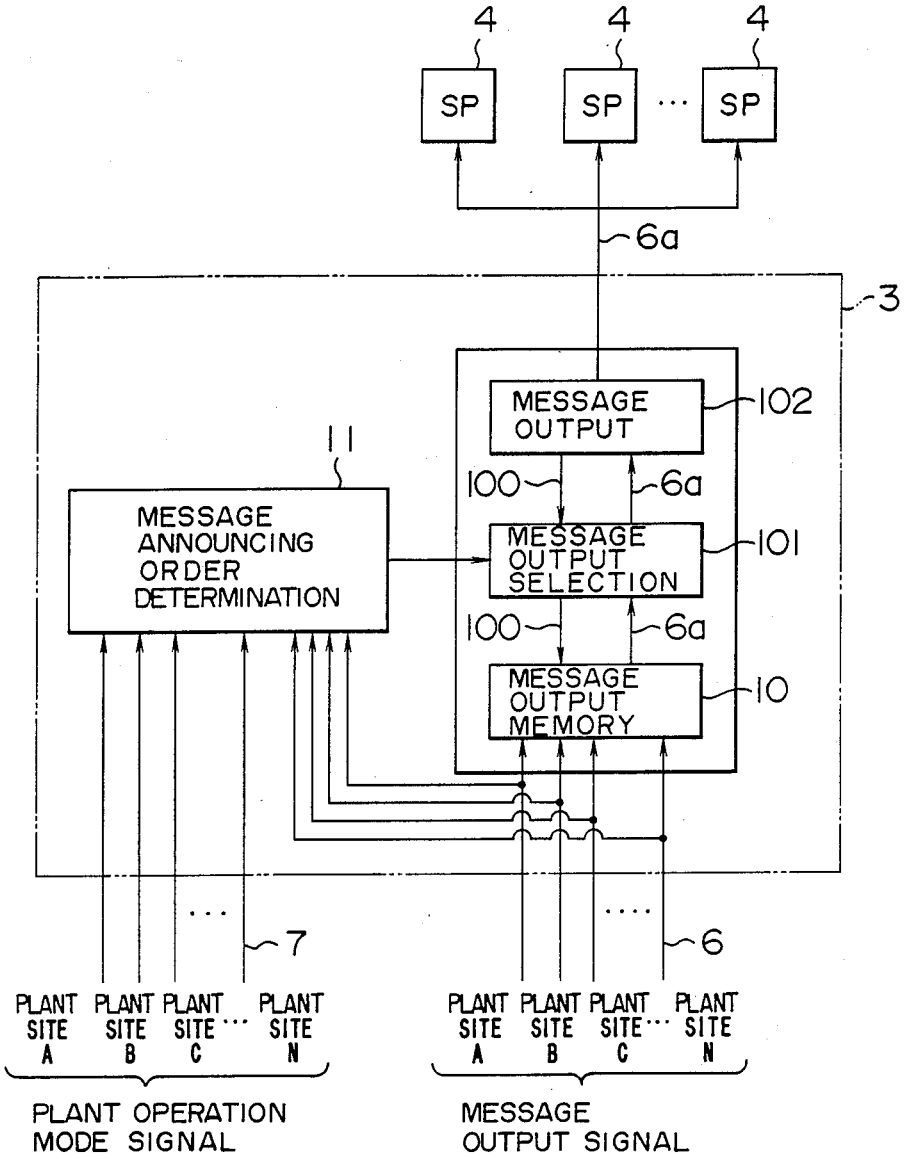
FIG. 2 is a block diagram illustrating the function of the message announcing order selection unit shown in FIG. 1.

FIG. 2 is a block diagram illustrating the function of the message announcing order selection unit 3 shown in FIG. 1. Voice message output signals 6 from the voice message signal generating units 2 of the individual plants are stored in a voice message signal memory 10. The voice message signals 6 are also applied, together with the plant operation mode information signals 7, to a message announcing order determination unit 11. Depending on the character of each voice message signal 6, that is, whether the voice message signal 6 relates to, for example, an alarm, informing of the occurrence of a serious problem in the corresponding plant, or guidance for plant operation, or depending on whether each plant operation mode information signal 7 informs that the corresponding plant is still in its starting stage or is not in operation, the message announcing order determination unit 11 determines the priority order of announcement of the voice message signals 6. According to the priority order determined by the message announcing order determination unit 11, the voice message signals *6a* selected by a message signal selection unit 101 are sequentially applied to a message output unit 102. After the received voice message signals *6a* have been announced from the speakers 4, the message output unit 102 applies to the message signal selection unit 101 a signal 100 which permits subsequent transmission of voice message signals. In response to this transmission permission signal 100, the message signal selection unit 101 selects from the voice message signal memory 10 the voice message signal *6a* having the highest priority among those stored in the memory 10 and applies the selected signal *6a* to the message output unit 102. Such operation is repeated. When, while a voice message signal transmitted from the message output unit 102 is being announced from the speaker 4, an emergency voice message signal having a higher priority is received by the message output unit 102, the announcement of the former signal may be interrupted, and the latter signal or emergency signal may be announced. Such interrupt processing is also included in the scope of the present invention.

The rule for determination of the priority order by the message announcing order determination unit 11 will now be described. Voice messages are classified into those having a higher degree of importance and those having a lower degree of importance depending on their contents. A serious problem, such as a problem occurring in a main piece of machinery or equipment, for example turbine or a boiler, and resulting in discontinuity of the plant operation must be announced with a priority higher than others. On the other hand, a guidance message issued to the operators as guidance for manual handling of a machine or equipment may not adversely affect the operation of other machines, equipments and plant even if the manual handling is done with a slight delay, and, in such a case, other messages may have a priority higher than that of the guidance message. When such a procedure is followed, the priority order of announcement of voice messages can be determined depending on the contents of the messages as, for example, tabulated in Table 1.

TABLE 1

| Example of determination of priority order according to contents of voice messages (type of message output signals 6) | |
|---|---|
| Priority order | Contents of Message |
| 1st | Voice message announcing serious trouble in main machinery and equipments |

TABLE 1-continued

| Example of determination of priority order according to contents of voice messages (type of message output signals 6) | |
|---|---|
| Priority order | Contents of Message |
| 2nd | Voice message announcing medium trouble in large auxiliary machinery and equipment |
| 3rd | Voice message announcing a change in operating conditions of main machinery and equipment |
| 4th | Voice message teaching actuation of automatically controlled machinery and equipment |
| 5th | Voice message announcing slight trouble in valves and small auxiliary machinery and equipment |
| 6th | Voice message announcing a change in operating conditions of auxiliary machinery and equipment |
| 7th | Voice message announcing guidance for actuation of automatically controlled machinery and equipment |

Needless to mention, it is previously set forth that the voice message provided by any one of the voice message output signals 6 corresponds to one of the seven kinds of voice messages described above. Therefore, the priority order of the individual voice message output signals 6 can be easily identified. However, there may be a case where a plurality of voice messages having the same priority appear simultaneously. For example, there may be a case where voice message signals having the second priority are generated simultaneously from the voice message signal generating units 2 associated with plant sites A and N. To deal with such a case, the priority order is determined on the basis of the plant operation mode information signals 7 applied to the announcing order determination unit 11. That is, the priority order is determined depending on whether the specific plant is in operation or is not in operation or in a starting stage or in a stopping stage. The relative importance of voice messages under various operation modes of a specific plant is such that a voice message signal generated from the message signal generating unit 2 of a plant when the plant is in operation has a priority over a voice message signal generated when the plant is not in operation. Also, when the plant is in operation, a voice message signal generated in a starting stage has a priority over that generated in a stopping stage, and the voice message signal generated in the stopping stage has a priority over that generated during the steady operation. Also, in the case of parallel operation of the plant with other plants for power generation, a voice message signal generated in a starting stage after the plant is placed in the parallel operation mode has a priority over that generated before the plant is placed in the parallel operation mode. On the other hand, in the case of the parallel-off mode of the plant, a voice message signal generated in a stopping stage before the plant is released from the parallel operation mode has a priority over that generated after the plant is released from the parallel operation mode. Table 2 summarizes the priority order of such voice messages appearing in the various operation modes. It will be seen from Table 2 that the priority order of those voice messages can be easily determined even when voice messages having the same priority appear in an overlapping relation.

TABLE 2

| Example of determination of priority order according to plant operation modes provided by plant operation mode signals 7 (secondary determination) | |
|---|---|
| Priority order | Operation mode |
| 1st | Starting stage (after parallel-in) |
| 2nd | Starting stage (before parallel-in) |
| 3rd | Stopping stage (before parallel-off) |
| 4th | Stopping stage (after parallel-off) |
| 5th | Steady operation (changing load) |
| 6th | Steady operation (fixed load) |
| 7th | Not in operation |

Figure 3:
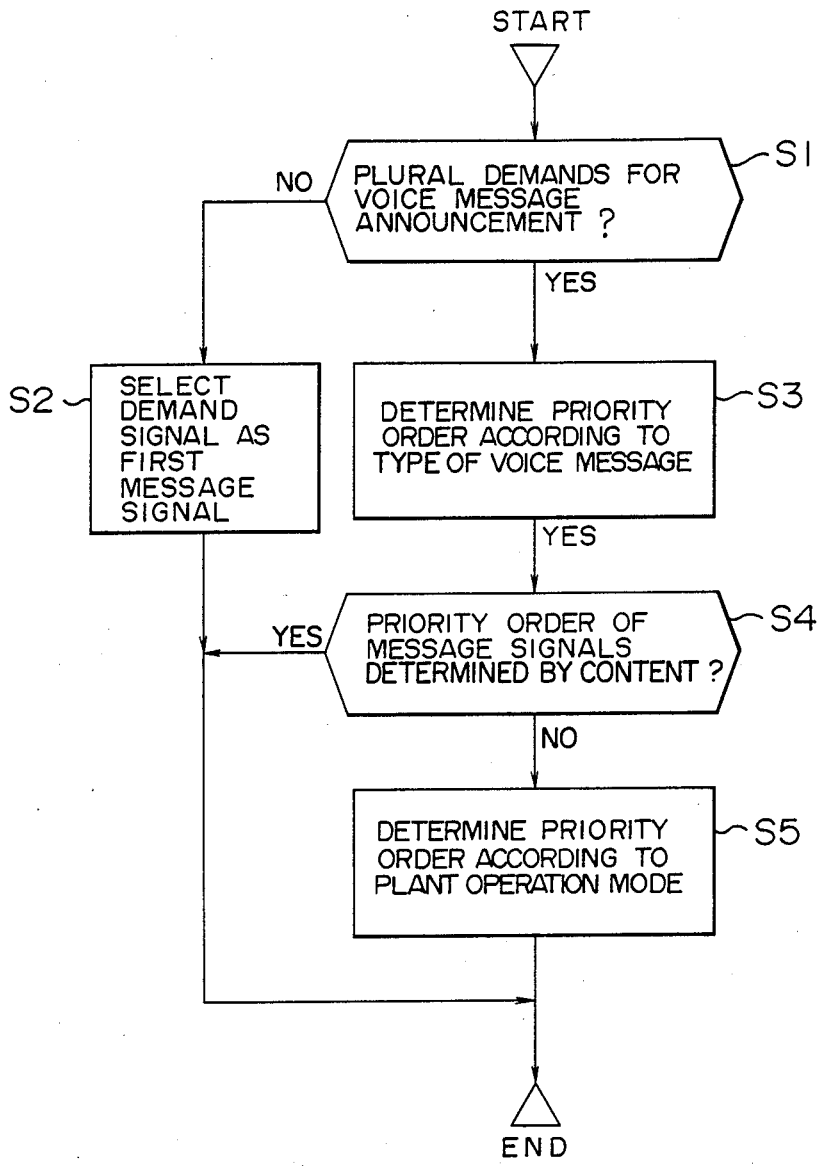
FIG. 3 is a flow chart showing a practical example of the operation of the message announcing order selection unit shown in FIG. 2.

FIG. 3 is a flow chart showing, by way of example, the steps of processing in the voice message announcing order determination unit 11 shown in FIG. 2. In response to the application of voice message output signals 6 and plant operation mode information signals 7, the following steps of processing are executed.

The flow shown in FIG. 3 starts in response to the application of a voice message signal 6 to the voice message announcing order determination unit 11. First, in step S1, a determination is made as to whether or not there are a plurality of demands for voice message announcement (voice message signals 6). When the in step S1 proves that there is only one demand, that is, only one voice message signal 6, this voice message signal 6 is applied in step S2 as a first message signal to the message signal selection unit 101 shown in FIG. 2. The message signal selection unit 101 selects this first message signal 6, and the message signal 6 is applied through the message output unit 102 to the corresponding speaker 4 which announces the voice message. On the other hand, when plural, for example two, voice message signals 6 are simultaneously applied, the priority order and the type of voice message signals 6 shown in Table 1 are referenced in step S3 to classify them into a first message signal and a second message signal according to the predetermined priority order. When these two voice message signals 6 do not have same priority as determined in step S4, and the result is "NO", the first and second message signals are announced in that order. On the other hand, when these voice message signals 6 have the same priority, the plant operation mode information signals 7 are utilized to determine the priority order in step S5 according to the rule shown in Table 2. After determination of the priority order in the manner described above, the first message signal is selected in the message signal selection unit 101 and is announced from the corresponding speaker 4. At the end of announcement of the first message signal, the message announcing order determination unit 11 may have received one or more voice message signals 6, and the priority order is determined again according to the flow shown in FIG. 3. Therefore, when no demand for message announcement is applied during announcement of the first message signal or even when one or more voice message signals 6, having priority lower than that of the second message signal, are applied during announcement of the first message signal, the second message signal selected in the step S5 is announced now as a new first message signal. On the other hand, when a voice message signal having priority higher than that of the second message signal is applied during announcement of the first message signal, such a message signal is announced earlier than the second message signal.

It will be seen from the above description that voice message signals are necessarily announced in the order determined according to their relative importance, so that really important information required for the operators can be immediately announced without the possibility of operators' mishearing because of intermixture of announced messages.

The meritorious effects of the present invention will be described with reference to FIG. 4B. FIG. 4A shows a prior art pattern of voice message announcements in each of plant sites A, B, C, . . . , N. It will be seen that the prior art patterns of voice message announcement are independent of one another, and the voice messages overlap each other in time intervals $t_1$, $t_2$, $t_3$ and $t_4$. Therefore, an operator hears the intermixed messages in those time intervals and finds it difficult to clearly distinguish the contents of the announced messages.

Figures 4A, 4B:
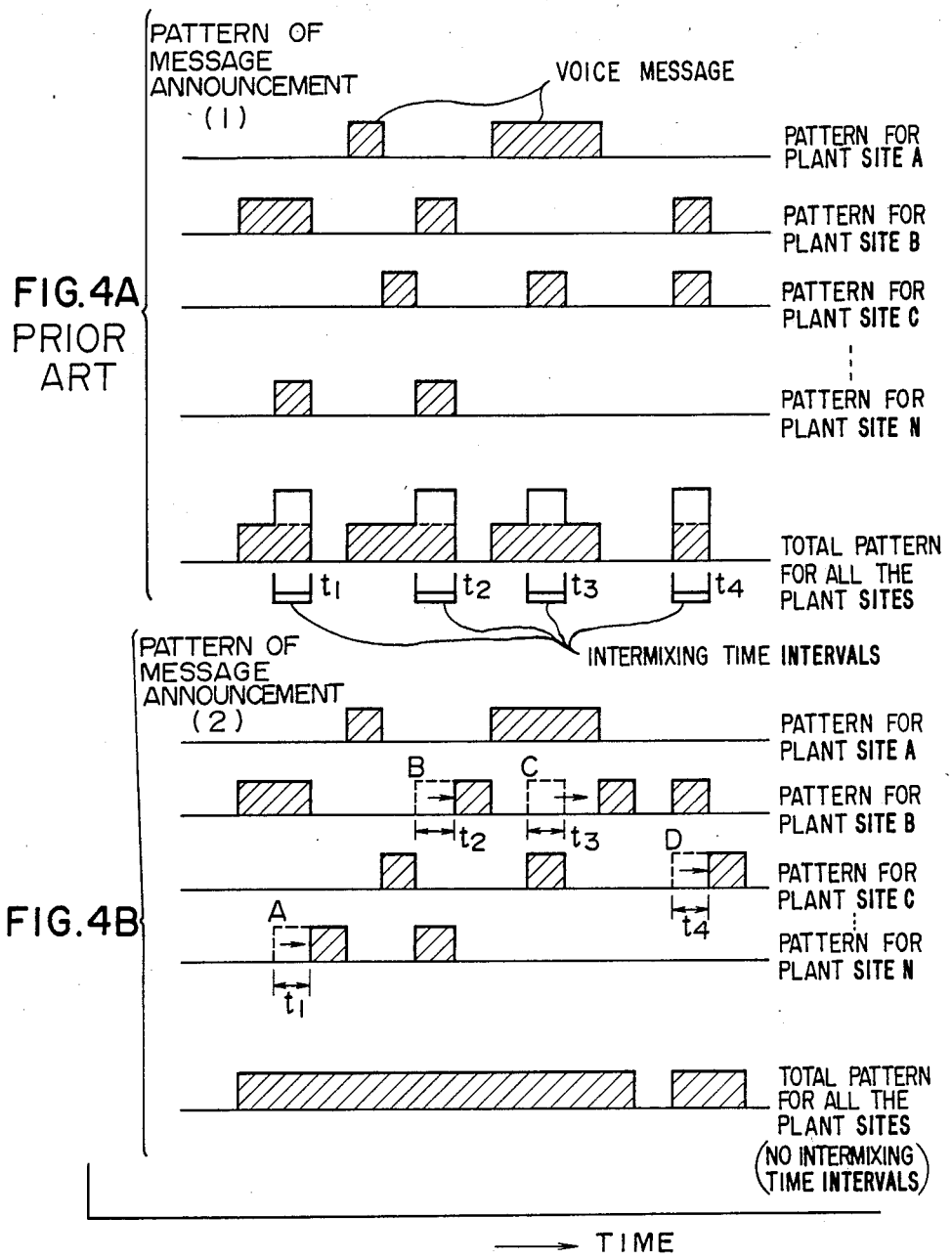
FIG.4A PRIOR ART
FIG. 4A shows a message announcing pattern according to a prior art system.
FIG. 4B shows a message announcing pattern according to this invention.

In contrast, FIG. 4B shows the pattern of voice message announcement in each of plant sites A, B, C, . . . , N when using the present invention. It will be seen that in time intervals $t_1$, $t_2$, $t_3$ and $t_4$, where announced messages overlap each other, those voice message signals having priority lower than the others are announced with a suitable delay according to the priority order, so as to solve the problem of intermixture of announced messages.

The present invention in which voice messages can be serially announced is advantageous in that no intermixture of announced messages occurs regardless of the number of independent voice message announcing devices.

We claim:

1. A voice message announcing method for a plurality of plant sites, said method comprising the steps of:

(a) identifying the state of an operating condition at each of a plurality of plant sites;

(b) for each plant site selecting from among a plurality of voice message signals a voice message signal indicative of the identified state at the plant site;

(c) determining an order of announcement for the selected voice message signals in accordance with a predetermined priority order; and (d) announcing the selected voice message signals in accordance with the determined order of announcement.

2. A voice message announcing method as claimed in claim 1, wherein step (b) comprises:

preparing for each plant site a plant operating instruction in accordance with the identified state at the plant site; and selecting a voice message signal for each plant operating instruction.

3. A voice message announcing method as claimed in claim 1, further comprising:

temporarily storing the selected voice message signals.

4. A voice message announcing method according to claim 1, 2, or 3, wherein the state of the operating condition at each of said plurality of plant sites is identified by analyzing plant condition information, a process signal, or another voice message signal indicating the state of the operating condition at said each plant.

5. A voice message announcing method according to claim 1, 2, or 3, wherein the order of announcement of the voice message signals is determined by analyzing the seriousness of problems occurring at each plant site or the operation mode at each plant site.

6. A voice message announcing method according to claim 1, 2, or 3 further comprising the steps of:

assigning a level of urgency to each voice message signal;

stopping the announcement of the selected voice message signal when a voice message signal is prepared having a level of urgency higher than the level of urgency of the selected voice message signal; and announcing the voice message signal having the higher level of urgency.

7. A voice message announcing system for a plurality of plant sites, said system comprising:

a plurality of identifying means, one identifying means at each of a like plurality of plant sites for identifying the state of an operating condition at the associated plant site;

a like plurality of voice message signal generating means, one voice signal generating means being provided at each plant site for generating a voice message signal indicative of the identified state at the associated plant site;

announcing order selecting means common to said plurality of plant sites for selecting an order of announcement for the generated voice message signals; and voice message signal announcing output means for announcing the voice message signals in the selected order of announcement.

8. A voice message announcing system as claimed in claim 7, wherein each of said plurality of voice signal generating means comprises:

an operation instruction preparing means for preparing an operation instruction in accordance with the identified state at the associated plant site; and a voice message signal generating device for generating a voice message signal indicative of the operation instruction for the associated plant site.

9. A voice message announcing system according to claim 7 or 8, wherein each of said identifying means includes means for identifying the state of the operating condition of the associated plant by analyzing plant condition information, a process signal, or another voice signal message indicating the state of the operating condition at the associated plant site.

10. A voice message announcing system according to claim 7 or 8, wherein said announcing order selecting means includes means for determining the order of announcement based on the seriousness of problems occurring at each plant site or on the operation mode at each plant site.

11. A voice message announcing system according to claim 7 or 8, further comprising:

urgency level assigning means common to said plurality of plant sites for assigning a level of urgency to the voice message signals; and message interrupt means responsive to preparation of a voice message assigned a higher priority level during announcing of a voice message signal of a lower priority level for interrupting the announcing of the lower priority level message and announcing the higher priority voice message signal.

* * * * *